US010077911B2

(12) United States Patent
Kubono et al.

(10) Patent No.: US 10,077,911 B2
(45) Date of Patent: Sep. 18, 2018

(54) OUTDOOR UNIT

(71) Applicant: Mitsubishi Electric Corporation, Tokyo (JP)

(72) Inventors: Toshiyuki Kubono, Tokyo (JP); Hiroyuki Jinnai, Tokyo (JP); Tomoya Yanase, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 15/526,786

(22) PCT Filed: Feb. 16, 2015

(86) PCT No.: PCT/JP2015/054169
§ 371 (c)(1),
(2) Date: May 15, 2017

(87) PCT Pub. No.: WO2016/132443
PCT Pub. Date: Aug. 25, 2016

(65) Prior Publication Data

US 2017/0328587 A1 Nov. 16, 2017

(51) Int. Cl.
*F24F 1/56* (2011.01)
*F24F 1/60* (2011.01)

(52) U.S. Cl.
CPC . *F24F 1/56* (2013.01); *F24F 1/60* (2013.01)

(58) Field of Classification Search
CPC ..... F24F 1/60; F24F 1/56; F24F 1/18; F24F 1/50; F24F 1/12; F24F 1/46; F24F 13/20
USPC ..... 60/498
See application file for complete search history.

(56) References Cited

U.S. PATENT DOCUMENTS 6,065,299 A * 5/2000 Chen ..... F24F 13/224 62/277
2009/0038328 A1* 2/2009 Piccione ..... F24F 13/222 62/291
2010/0011803 A1* 1/2010 Warnecker ..... F24F 1/12 62/498
2011/0185763 A1* 8/2011 Wakashima ..... F24F 1/06 62/434
2011/0219803 A1* 9/2011 Park ..... F24F 1/26 62/238.6

(Continued)

FOREIGN PATENT DOCUMENTS

JP 2001-165472 A 6/2001
JP 2004-177019 A 6/2004

(Continued)

OTHER PUBLICATIONS

International Search Report of the International Searching Authority dated May 19, 2015 for the corresponding international application No. PCT/JP2015/054169 (and English translation).

*Primary Examiner* — Mohammad M Ali
(74) *Attorney, Agent, or Firm* — Posz Law Group, PLC

(57) ABSTRACT

An outdoor unit includes a casing having a bottom panel formed in a rectangular shape in a planar view. The bottom panel includes a bottom portion constituting a lower face of the casing, and a rising portion rising from an outer peripheral edge of the bottom portion. A first holding part is provided to the rising portion on a side of one side face of the casing, and a second holding part is provided to the rising portion on a side of the other side face of the casing opposite to the side of the one side face.

8 Claims, 9 Drawing Sheets

(56) References Cited

U.S. PATENT DOCUMENTS

2012/0195000 A1* 8/2012 Hika ..... F24F 1/24
361/692

FOREIGN PATENT DOCUMENTS

JP 2005-221142 A 8/2005
JP 2011-158163 A 8/2011

* cited by examiner

OUTDOOR UNIT

CROSS REFERENCE TO RELATED APPLICATION

This application is a U.S. national stage application of PCT/JP2015/054169 filed on Feb. 16, 2015, the disclosures of which are incorporated herein by reference.

TECHNICAL FIELD

The present invention relates to an outdoor unit.

BACKGROUND ART

A conventional outdoor unit with handles provided in the vicinity of both right and left ends of the bottom plate (bottom part) has been known (see Patent Literature 1, for example). In the outdoor unit described in Patent Literature 1, the handles are formed to protrude downward from the lower face of the bottom plate.

CITATION LIST

Patent Literature

Patent Literature 1: Japanese Unexamined Patent Application Publication No. 2004-177019

SUMMARY OF INVENTION

Technical Problem

As described above, in the outdoor unit described in Patent Literature 1, handles protrude downward from the lower face of the bottom plate. Consequently, the casing is required to be configured in consideration of the protruding amount of the handles protruding downward from the lower face of the bottom plate. That is, providing handles causes a limitation on the inner structure of the casing.

The present invention has been made in view of the problem described above. An object of the present invention is to provide an outdoor unit including the casing configured to be more freely structured, compared with conventional outdoor units.

Solution to Problem

An outdoor unit according to an embodiment of the present invention includes a casing having a bottom panel formed in a rectangular shape in a planar view. The bottom panel includes a bottom portion constituting a lower face of the casing, and a rising portion rising from an outer peripheral edge of the bottom portion. A first holding part is provided to the rising portion on a side of one side face of the casing, and a second holding part is provided to the rising portion on a side of the other side face of the casing opposite to the side of the one side face.

Advantageous Effects of Invention

According to the embodiment of the present invention, the first holding part is provided to the rising portion on the side of the one side face of the casing, and the second holding part is provided to the rising portion on the side of the other side face of the casing opposite to the side of the one side face. Consequently, the holding parts for holding the outdoor unit do not protrude downward from the lower face of the bottom portion. Thus, the size of the casing does not have to be reduced in consideration of providing the holding parts, and the height of the casing does not have to be increased in consideration of providing the holding parts. A limitation on the structure of the casing is removed or reduced, compared with the conventional outdoor units.

DESCRIPTION OF EMBODIMENTS

Figure 1:
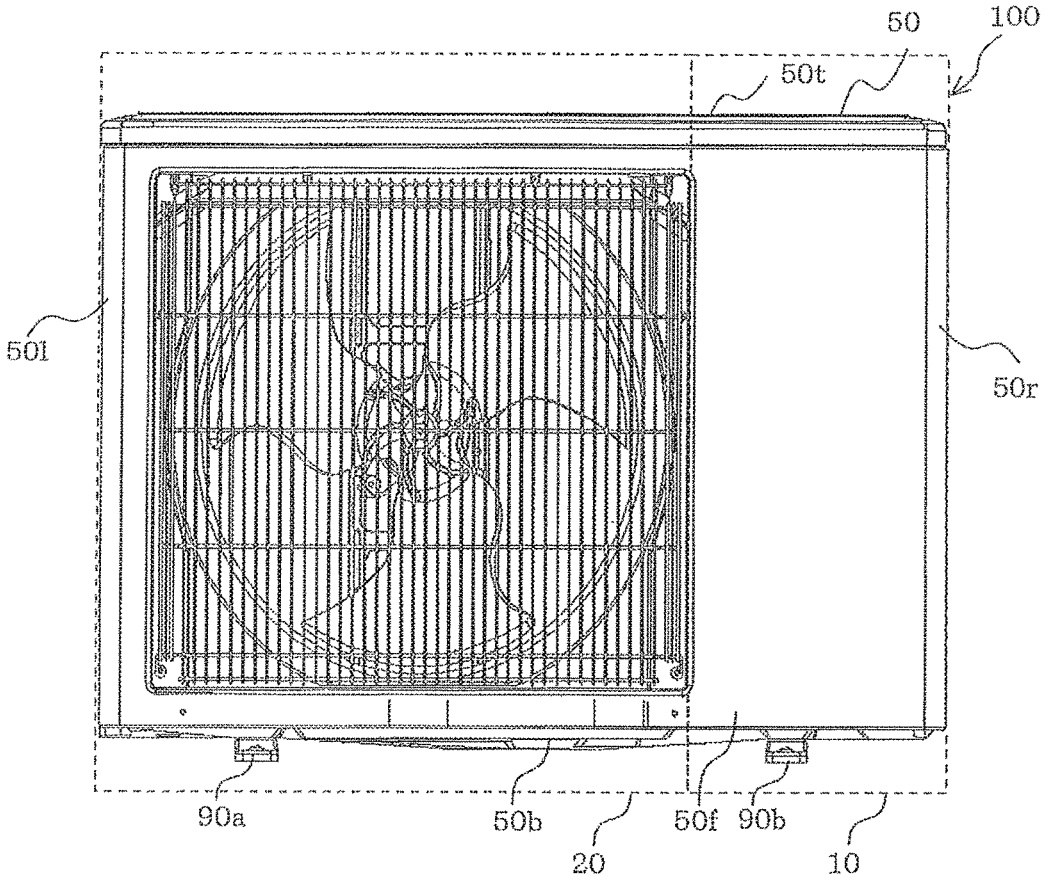
FIG. 1 is a front view of an outdoor unit 100 according to Embodiment 1 of the present invention.

Hereinafter, an outdoor unit of the present invention will be described in detail with reference to the drawings. In the drawings provided below, a magnitude relation between constituent members may be different from an actual magnitude relation. Further, in the drawings provided below, constituent members denoted by the same reference signs are the same or corresponding constituent members. The reference signs are common throughout the description. Further, the forms of the constituent elements described in the description are merely illustrative and the forms of the constituent elements are not limited to the described forms.

Embodiment 1

Figure 2:
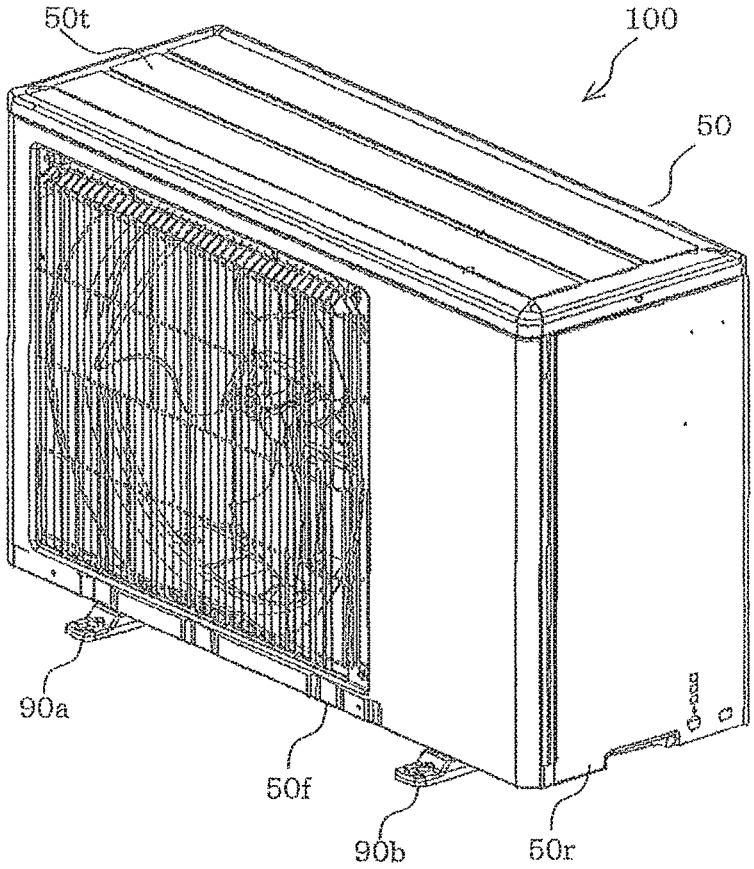
FIG. 2 is a perspective view of the outdoor unit 100 according to Embodiment 1 of the present invention.

FIG. 1 is a front view of an outdoor unit 100 according to Embodiment 1 of the present invention. FIG. 2 is a perspective view of the outdoor unit 100 according to Embodiment 1 of the present invention.

As illustrated in FIGS. 1 and 2, the outer enclosure of the outdoor unit 100 is formed of a casing 50. The casing 50 includes a bottom panel 50*b*, a rear panel 50*e* (FIG. 4), a front panel 50*f*, a left side panel 50*l*, a right side panel 50*r*, and a top panel 50*t*. The casing 50 has a machine room 10 and a fan room 20 inside the casing 50.

The bottom panel 50*b* is a member constituting the bottom face of the casing 50. The rear panel 50*e* is a member constituting the rear face of the casing 50. The front panel 50*f* is a member constituting the front face of the casing 50. The left side panel 50*l* is a panel constituting the left side face of the casing 50. The right side panel 50*r* is a member constituting the right side face of the casing 50. The top panel 50*t* is a member constituting the top face of the casing 50. The front panel 50*f* and the left side panel 50*l* may be formed integrally or separately. The casing 50 accommodates various types of members constituting the outdoor unit 100.

The bottom panel 50*b* is provided with leg parts 90*a* and 90*b*. The leg parts 90*a* and 90*b* contact with the installation face of the outdoor unit 100. The leg part 90*a* is provided to a fan room 20 side from the leg part 90*b*. The leg part 90*b* is provided to a machine room 10 side from the leg part 90*a*. With the leg parts 90*a* and 90*b*, a space is provided between the bottom panel 50*b* and the installation face, allowing a worker to lift up the casing 50 easily and carry the outdoor unit 100 easily. In the description below, the leg parts 90*a* and 90*b* may be collectively referred to as a leg part 90.

The casing 50 accommodates a partition plate (not shown), a compressor (not shown), an electrical component box (not shown), an outdoor heat exchanger 21 (FIG. 7), a fan (not shown), and other constituent members. With the partition plate, the inside of the casing 50 is divided into the machine room 10 and the fan room 20. The machine room 10 is provided with the compressor and the electrical component box. The fan room 20 is provided with the outdoor heat exchanger 21, the fan, and a fan motor.

The compressor compresses refrigerant and discharges it as high-temperature and high-pressure refrigerant. The electrical component box stores various constituent members required for operating the outdoor unit 100. In the electrical component box, a control unit (not shown) is provided, for example.

The outdoor heat exchanger 21 is an L-shaped heat exchanger in a planar view, for example, and is provided along the left side panel 50*l* and the rear panel 50*e*. The outdoor heat exchanger 21 is provided closer to the rear face side of the outdoor unit 100 than the fan and the fan motor are. The outdoor heat exchanger 21 acts as an evaporator during heating operation, and acts as a condenser during cooling operation.

The fan is an air-sending unit configured of a propeller fan, for example. When the fan is rotated, the outside air is introduced from the rear face side of the casing 50 into the casing 50, and the outside air introduced into the casing 50 is discharged toward the front face side of the casing 50. The fan motor is a driving unit for rotating the fan.

The control unit controls the fan motor to regulate the rotation frequency of the fan. By regulating the rotation frequency of the fan, the flow rate of the air passing through the outdoor heat exchanger 21 can be regulated. The control unit is configured of, for example, hardware such as a circuit device having the regulation function, or software executed on an arithmetic unit such as a microcomputer and a CPU.

When the control unit controls the fan motor to rotate the fan, heat is exchanged between the air introduced from the rear face side of the casing 50 into the casing 50, and the refrigerant flowing in the outdoor heat exchanger 21. The air, having exchanged heat with the refrigerant flowing in the outdoor heat exchanger 21, is discharged to the front face side of the casing 50.

Figure 3:
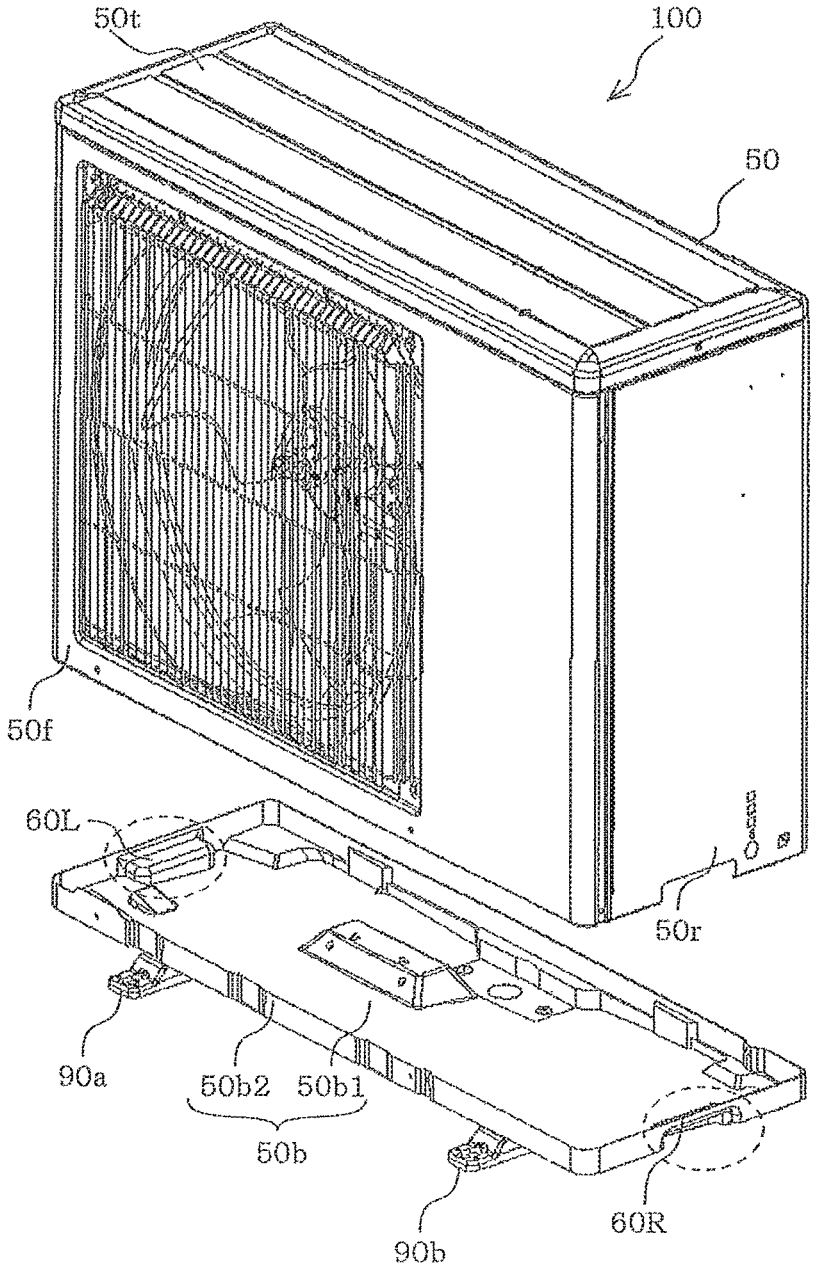
FIG. 3 is a perspective view of the outdoor unit 100 according to Embodiment 1 of the present invention, in which a bottom panel 50*b* and the other constituent members of a casing 50 are separated from each other.
Figure 4:
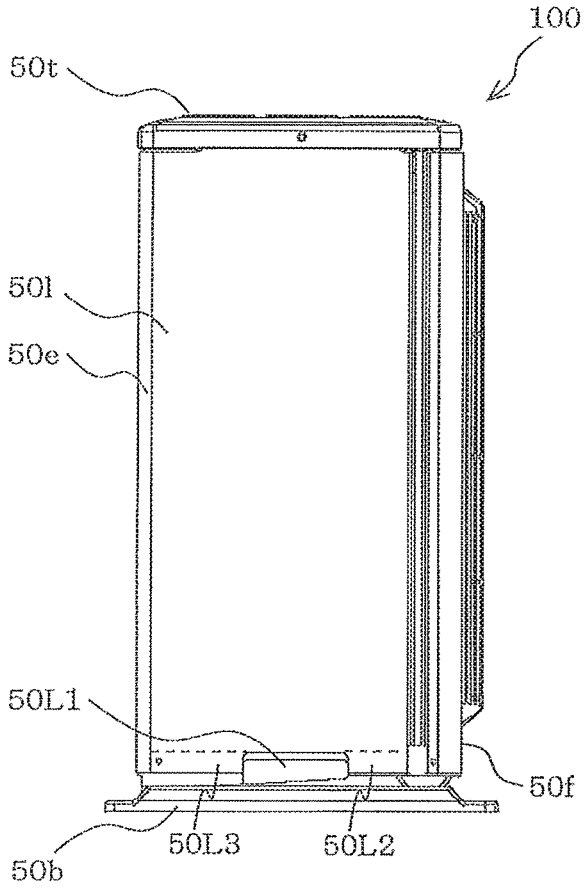
FIG. 4 is a left side view of the outdoor unit 100 according to Embodiment 1 of the present invention.
Figure 5:
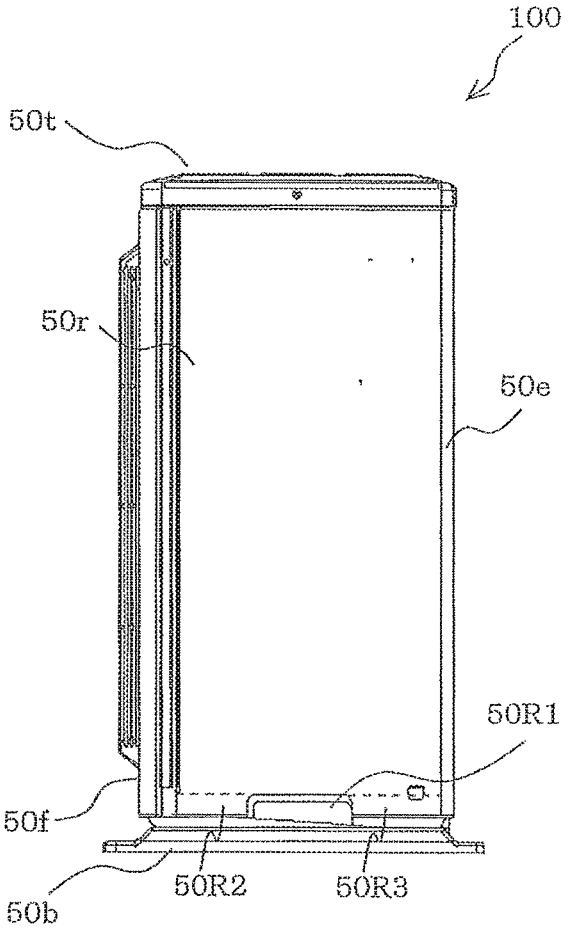
FIG. 5 is a right side view of the outdoor unit 100 according to Embodiment 1 of the present invention.

FIG. 3 is a perspective view of the outdoor unit 100 according to Embodiment 1 of the present invention, in which the bottom panel 50*b* and the other constituent members of the casing 50 are separated from each other. FIG. 4 is a left side view of the outdoor unit 100 according to Embodiment 1 of the present invention. FIG. 5 is a right side view of the outdoor unit 100 according to Embodiment 1 of the present invention.

As illustrated in FIG. 3, the bottom panel 50*b* includes a bottom portion 50*b*1 and a rising portion 50*b*2, and is formed of a rectangular member in a planar view, for example. The bottom portion 50*b*1 constitutes the lower face of the casing 50. The rising portion 50*b*2 rises from the outer peripheral edge of the bottom portion 50*b*1.

The bottom panel 50*b* is provided with a first holding part 60L and a second holding part 60R. The first holding part 60L and the second holding part 60R are parts held by a worker when the worker lifts up the outdoor unit 100. The first holding part 60L is provided to an end portion, on a side of the fan room 20, of the rising portion 50*b*2. The first holding part 60L is formed by denting a corner portion extending from the bottom panel 50*b* to the left side panel 50*l*, for example. The second holding part 60R is provided at an end portion, on a side of the machine room 10, of the rising portion 50*b*2. The second holding part 60R is formed by denting a corner portion extending from the bottom panel 50*b* to the right side panel 50*r*.

As illustrated in FIG. 4, the left side panel 50*l* is provided with a first recess portion 50L1 at a lower end of the left side panel 50*l*. The first recess portion 50L1 is in a recessed shape with which, in a state where the casing 50 is assembled, a worker is able to hold the first holding part 60L from the left side face side of the casing 50, for example. At a position closer to the front face side of the casing 50 than the first recess portion 50L1 is, a left side face side front end portion 50L2 is provided, and at a position closer to the rear face side of the casing 50 than the first recess portion 50L1, a left side face side rear end portion 50L3 is provided.

As illustrated in FIG. 5, the right side panel 50*r* is provided with a second recess portion 50R1 at a lower end of the right side panel 50*r*. The second recess portion 50R1 is in a recessed shape with which, in a state where the casing 50 is assembled, a worker is able to hold the second holding part 60R from the right side face side of the casing 50, for example. At a position closer to the front face side of the casing 50 than the second recess portion 50R1 is, a right side face side front end portion 50R2 is provided, and at a position closer to the rear face side of the casing 50 than the second recess portion 50R1, a right side face side rear end portion 50R3 is provided.

Figure 6:
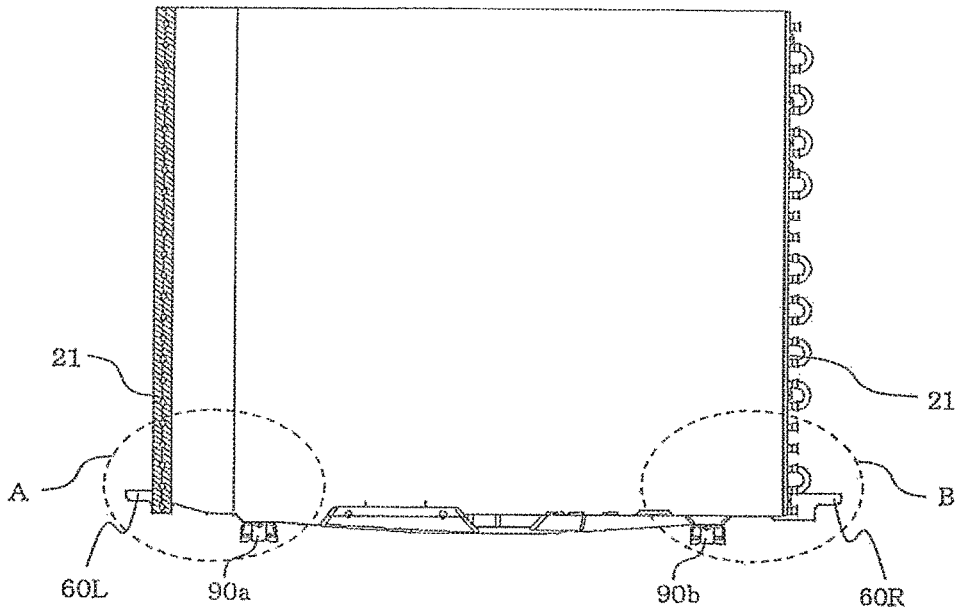
FIG. 6 illustrates a positional relationship between an outdoor heat exchanger 21 and leg parts 90 of the outdoor unit 100 according to Embodiment 1 of the present invention.
Figure 7:
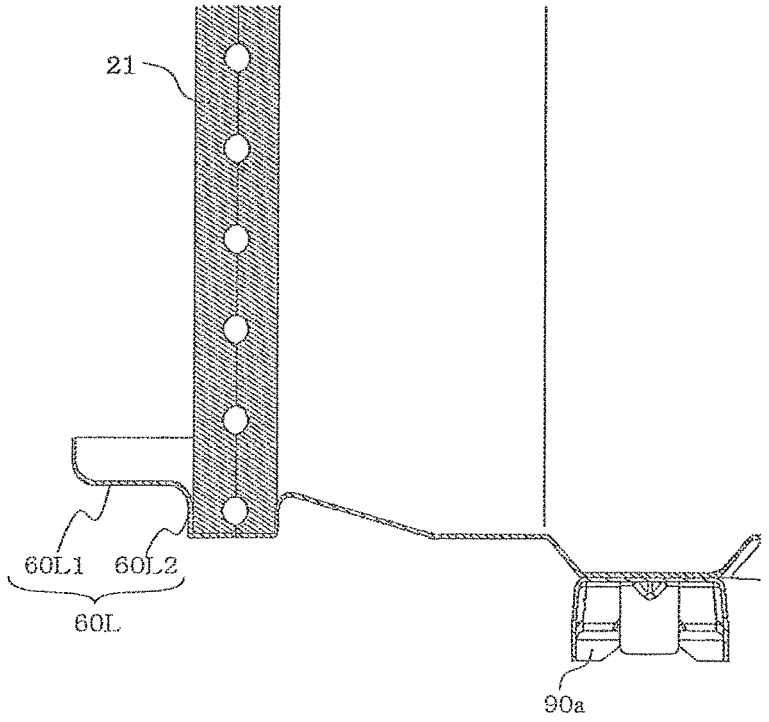
FIG. 7 is an enlarged view of a portion A of FIG. 6.
Figure 8:
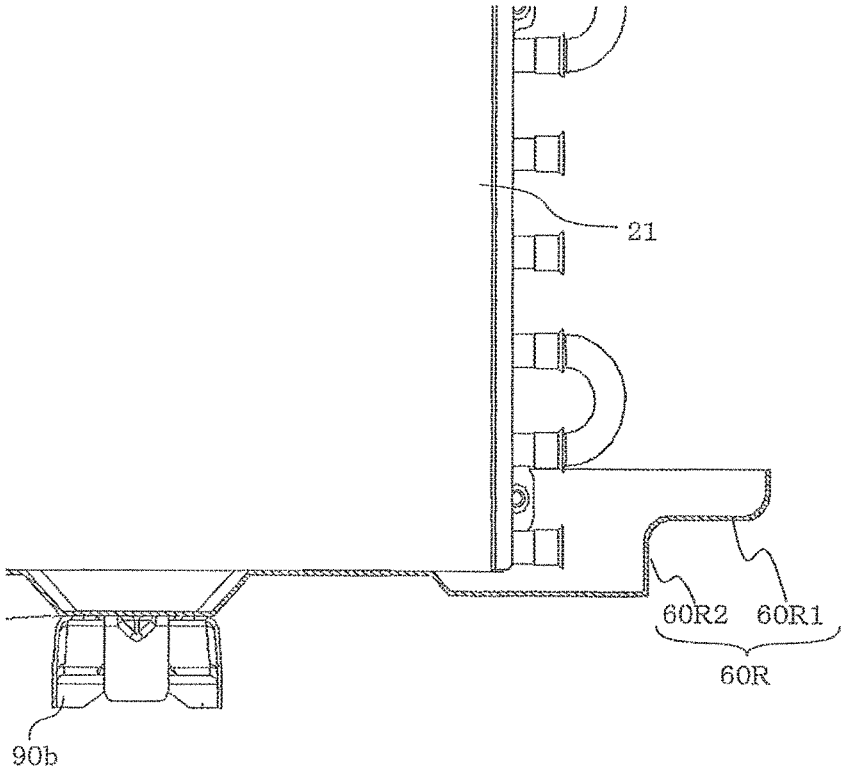
FIG. 8 is an enlarged view of a portion B of FIG. 6.
Figure 9:
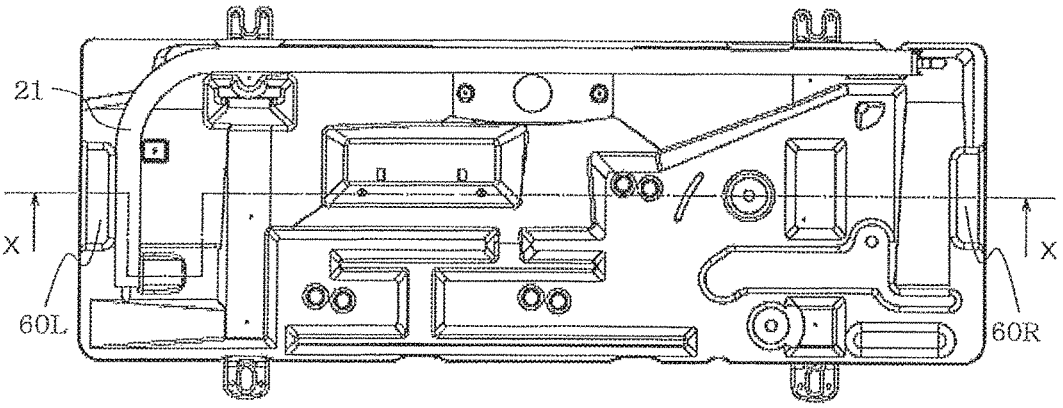
FIG. 9 illustrates an upper face of the bottom panel 50*b* of the outdoor unit 100 according to Embodiment 1 of the present invention.
Figure 10:
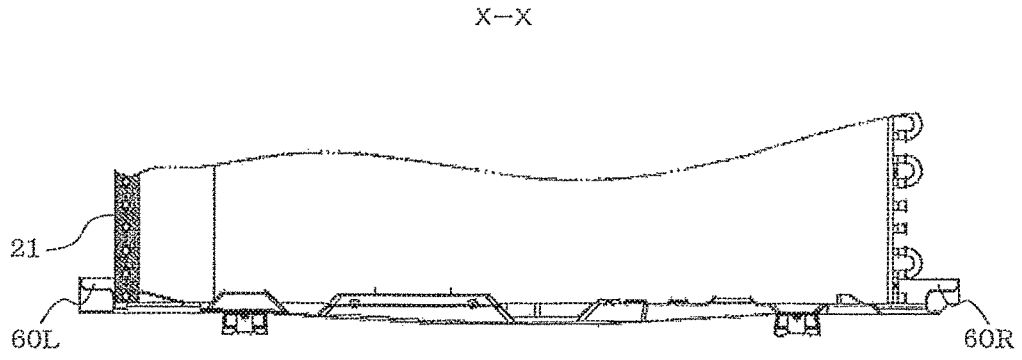
FIG. 10 is a cross-sectional view taken along a line X-X of FIG. 9.

FIG. 6 illustrates a positional relationship between the outdoor heat exchanger 21 and the leg parts 90 of the outdoor unit 100 according to Embodiment 1 of the present invention. FIG. 7 is an enlarged view of a portion A of FIG. 6. FIG. 8 is an enlarged view of a portion B of FIG. 6. FIG. 9 illustrates an upper face of the bottom panel 50*b* of the outdoor unit 100 according to Embodiment 1 of the present invention. FIG. 10 is a cross-sectional view taken along a line X-X of FIG. 9.

As illustrated in FIGS. 6, 7, 9, and 10, the outdoor heat exchanger 21 is provided with the first holding part 60L at a lower end portion on the side of the fan room 20. As illustrated in FIG. 7, the first holding part 60L is configured of a first flat portion 60L1 and a first standing portion 60L2. The first flat portion 60L1, which extends horizontally above the bottom portion 50*b*1, is to be held by a hand of a worker. The first standing portion 60L2 extends vertically inside the outer peripheral edge of the first flat portion 60L1. A portion of the first flat portion 60L1 farthest from the outer periphery of the bottom portion 50*b*1 and the top of the first standing portion 60L2 are continuously formed to be in a substantial L shape. The first standing portion 60L2 and the outdoor heat exchanger 21 contact with each other.

As illustrated in FIGS. 6, 8, 9, and 10, the outdoor heat exchanger 21 is provided with the second holding part 60R at a lower end portion on the side of the machine room 10. As illustrated in FIG. 8, the second holding part 60R is configured of a second flat portion 60R1 and a second standing portion 60R2. The second flat portion 60R1, which extends horizontally above the bottom portion 50*b*1, is to be held by a hand of a worker. The second standing portion 60R2 extends vertically inside the outer peripheral edge of the second flat portion 60R1. A portion of the second flat portion 60R1 farthest from the outer peripheral edge of the bottom portion 50*b*1 and the top of the second standing portion 60R2 are continuously formed to be in a substantial L shape.

As described above, the outdoor unit 100 according to Embodiment 1 is provided with the casing 50 having the bottom panel 50*b* formed in a rectangular shape in a planar view. The bottom panel 50*b* includes the bottom portion 50*b*1 constituting the lower face of the casing 50, and the rising portion 50*b*2 rising from the outer peripheral edge of the bottom portion 50*b*1. The rising portion 50*b*2 is provided with the first holding part 60L at one side face side of the casing 50, and the rising portion 50*b*2 is provided with the second holding part 60R at the other side face side of the casing 50 opposite to the one side face side. Consequently, the holding parts for holding the outdoor unit 100 do not protrude downward from the lower face of the bottom portion 50*b*1. The size of the casing 50 does not have to be reduced in consideration of providing the holding parts, and the height of the casing 50 does not have to be increased in consideration of providing the holding parts. A limitation on the structure of the casing 50 is removed or reduced, compared with the conventional outdoor units. Further, as the first holding part 60L and the second holding part 60R are provided to the rising portion 50*b*2, that is, as the first holding part 60L and the second holding part 60R are provided on the side face sides of the casing 50, when a worker holds the first holding part 60L and the second holding part 60R, the holding parts can be more easily found to be held, compared with the case where the holding parts are provided on the lower face of the bottom portion 50*b*1.

Further, in the outdoor unit 100 according to Embodiment 1, the first holding part 60L includes the first flat portion 60L1 extending horizontally above the bottom portion 50*b*1, and the first standing portion 60L2 extending vertically inside the outer peripheral edge of the bottom portion 50*b*1. A portion of the first flat portion 60L1 farthest from the outer peripheral edge of the bottom portion 50*b*1 and the top of the first standing portion 60L2 are continuously formed, and the first standing portion 60L2 and the outdoor heat exchanger 21 contact with each other. Consequently, the outdoor heat exchanger 21 on the side of the fan room 20 in the casing 50 can be positioned at the outer side of the casing 50 than the conventional outdoor units. The inner space of the casing 50 can therefore be utilized effectively.

The first holding part 60L and the second holding part 60R may be extended along the front and back direction of the casing 50. In this case, the left side face side front end portion 50L2 and the left side face side rear end portion 50L3 may be cut off, and the right side face side front end portion 50R2 and the right side face side rear end portion 50R3 may be cut off, for example. Consequently, the areas are increased where a worker can hold the first holding part 60L and the second holding part 60R, and the cost of the left side panel 50*l* and the right side panel 50*r* can be reduced.

Further, a holding part can be further provided to the left side panel 50*l*, and a holding part can be further provided to the right side panel 50*r*. In this case, one of two workers can hold the first holding part 60L, and the other of the two workers can hold the holding part on the right side panel 50*r* provided above the second holding part 60R, rather than holding the second holding part 60R, to carry the outdoor unit 100, for example. Further, one of two workers can hold the second holding part 60R, and the other of the two workers can hold the holding part on the left side panel 50*l* provided above the first holding part 60L, rather than holding the first holding part 60L, to carry the outdoor unit 100. Consequently, the holding positions can be changed for various cases of carrying the outdoor unit 100. The holding part provided to the left side panel 50*l* and the holding part provided to the right side panel 50*r* each correspond to a "side face side holding part" of the present invention.

Embodiment 2

In Embodiment 2, a larger number of holding parts are provided to the bottom panel 50*b*, which is different from Embodiment 1. In Embodiment 2, items not described particularly are similar to those of Embodiment 1, and the same functions and configurations are described using the same reference signs.

Figure 11:
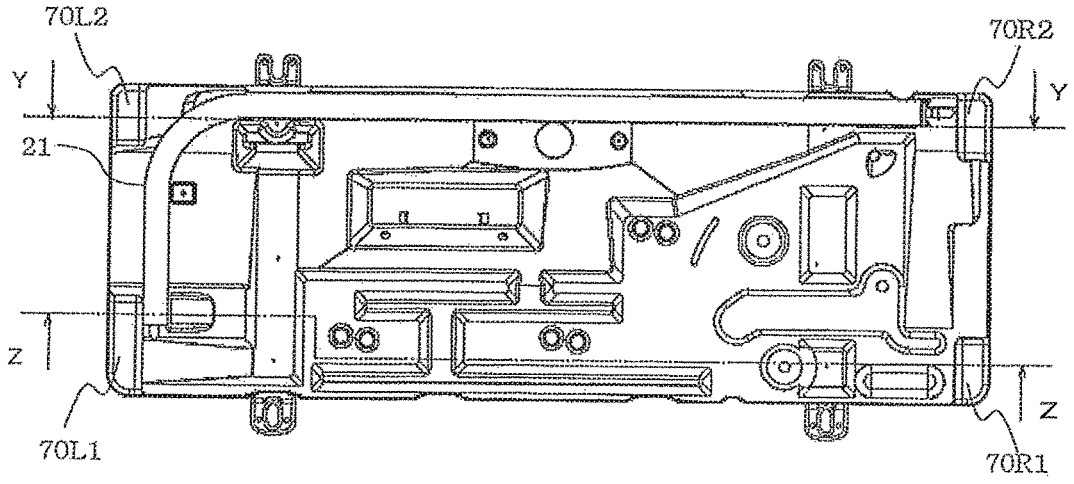
FIG. 11 illustrates an upper face of the bottom panel 50*b* of an outdoor unit 100 according to Embodiment 2 of the present invention.
Figure 12:
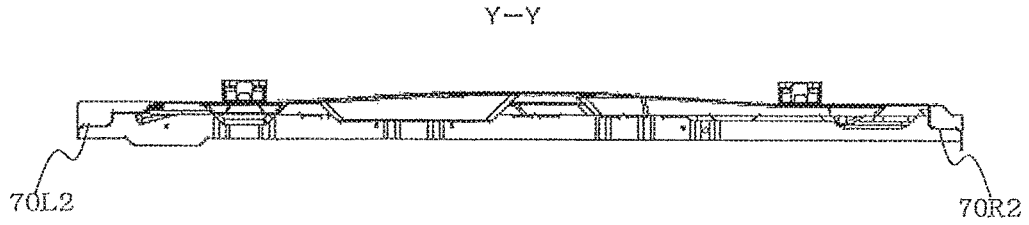
FIG. 12 is a cross-sectional view taken along a line Y-Y of FIG. 11.
Figure 13:
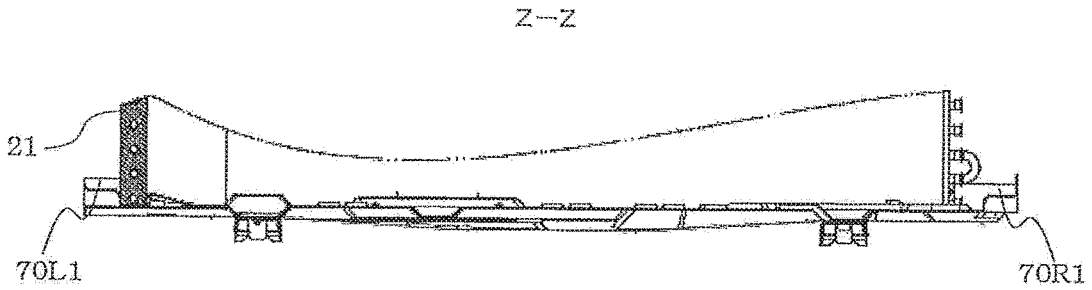
FIG. 13 is a cross-sectional view taken along a line Z-Z of FIG. 11.

FIG. 11 illustrates an upper face of the bottom panel 50*b* of the outdoor unit 100 according to Embodiment 2 of the present invention. FIG. 12 is a cross-sectional view taken along a line Y-Y of FIG. 11. FIG. 13 is a cross-sectional view taken along a line Z-Z of FIG. 11.

As illustrated in FIG. 11, the bottom panel 50*b* is provided with a first front side holding part 70L1, a first rear side holding part 70L2, a second front side holding part 70R1, and a second rear side holding part 70R2. Specifically, at four corners of the rising portion 50*b*2, the first front side holding part 70L1, the first rear side holding part 70L2, the second front side holding part 70R1, and the second rear side holding part 70R2 are provided, for example. The first front side holding part 70L1 and the first rear side holding part 70L2 are provided at two corners of the rising portion 50*b*2 on a side of the left side panel 50*l*. The second front side holding part 70R1 and the second rear side holding part 70R2 are provided at two corners of the rising portion 50*b*2 on a side of the right side panel 50*r*.

The first front side holding part 70L1 is provided to the bottom panel 50*b* on the side of the fan room 20 and on the front face side of the casing 50. The first rear side holding part 70L2 is provided to the bottom panel 50*b* on the side of the fan room 20 and on the rear face side of the casing 50. The second front side holding part 70R1 is provided to the bottom panel 50*b* on the side of the machine room 10 and on the front face side of the casing 50. The second rear side holding part 70R2 is provided to the bottom panel 50*b* on the side of the machine room 10 and on the rear face side of the casing 50.

As described above, in the outdoor unit 100 according to Embodiment 2, the first front side holding part 70L1 and the first rear side holding part 70L2 are provided at two corners located on the side of the left side panel 50*l*, and the second front side holding part 70R1 and the second rear side holding part 70R2 are provided at two corners located on the side of the right side panel 50*r*. Consequently, in Embodiment 2, the areas for holding the outdoor unit 100 can be increased, as compared to the case of providing holding parts as in Embodiment 1, and workability can be improved accordingly.

The left side panel 50*l* and the right side panel 50*r* each correspond to a "side face panel" of the present invention. Further, the first holding part 60L, the first front side holding part 70L1, and the first rear side holding part 70L2 each correspond to a "first holding part" of the present invention. Further, the second holding part 60R, the second front side holding part 70R1, and the second rear side holding part 70R2 each correspond to a "second holding part" of the present invention.

Further, the first holding part 60L may be provided to the bottom panel 50*b* on the side of the fan room 20, and the second front side holding part 70R1 and the second rear side holding part 70R2 may be provided to the bottom panel 50*b* on the side of the machine room 10.

Further, the first front side holding part 70L1 and the first rear side holding part 70L2 may be provided to the bottom panel 50*b* on the side of the fan room 20, and the second holding part 60R may be provided to the bottom panel 50*b* on the side of the machine room 10.

Further, in Embodiment 2, description has been given on the case where two holding parts are provided to the bottom panel 50*b* on the side of the fan room 20. However, the present invention is not limited to this case. For example, three or more holding parts may be provided to the bottom panel 50*b* on the side of the fan room 20. Specifically, in addition to the first front side holding part 70L1 and the first rear side holding part 70L2, another holding part may be provided to the bottom panel 50*b* on the side of the fan room 20, for example.

Further, in Embodiment 2, description has been given on the case where two holding parts are provided to the bottom panel 50*b* on the side of the machine room 10. However, the present invention is not limited to this case. For example, three or more holding parts may be provided to the bottom panel 50*b* on the side of the machine room 10, for example. Specifically, in addition to the second front side holding part 70R1 and the second rear side holding part 70R2, another holding part may be provided to the bottom panel 50*b* on the side of the machine room 10, for example.

REFERENCE SIGNS LIST

10 machine room 20 fan room 21 outdoor heat exchanger 50 casing 50L1 first recess portion 50L2 left side face side front end portion 50L3 left side face side rear end portion 50R1 second recess portion 50R2 right side face side front end portion 50R3 right side face side rear end portion 50*b* bottom panel 50*b*1 bottom portion 50*b*2 rising portion 50*e* rear panel 50*f* front panel 50*l* left side panel 50*r* right side panel 50*t* top panel 60L first holding part 60L1 first flat portion 60L2 first standing portion 60R second holding part 60R1 second flat portion 60R2 second standing portion 70L1 first front side holding part 70L2 first rear side holding part 70R1 second front side holding part 70R2 second rear side holding part 90, 90*a*, 90*b* leg part 100 outdoor unit

The invention claimed is:

1. An outdoor unit comprising:

a casing having a bottom panel formed in a rectangular shape in a planar view; and an outdoor heat exchanger provided inside the casing, the bottom panel including a bottom portion constituting a lower face of the casing, and a rising portion rising from an outer peripheral edge of the bottom portion, at least one first holding part being provided to the rising portion on a side of one side face of the casing, at least one second holding part being provided to the rising portion on a side of an other side face of the casing opposite to the side of the one side face, the at least one first holding part including a first flat portion extending horizontally above the bottom portion, and a first standing portion extending vertically inside the outer peripheral edge of the bottom portion, a portion of the first flat portion farthest from the outer peripheral edge of the bottom portion and a top portion of the first standing portion being continued to each other, the first standing portion and the outdoor heat exchanger contacting with each other.

2. The outdoor unit of claim 1, wherein the at least one first holding part comprises a plurality of first holding parts.

3. The outdoor unit of claim 1, wherein the at least one first holding part is each provided to at least two corners located on the side of the one side face among four corners of the rising portion.

4. The outdoor unit of claim 1, wherein the at least one second holding part comprises a plurality of second holding parts.

5. The outdoor unit of claim 1, wherein the at least one second holding part is each provided to at least two corners located on the side of the other side face among four corners of the rising portion.

6. The outdoor unit of claim 1, wherein the at least one second holding part includes a second flat portion extending horizontally above the bottom portion, and a second standing portion extending vertically inside the outer peripheral edge of the bottom portion, and a portion of the second flat portion farthest from the outer peripheral edge of the bottom portion and a top portion of the second standing portion are continued to each other.

7. The outdoor unit of claim 1, wherein the one side face constitutes one of faces defining a space in which a fan room accommodating a fan is provided, and the other side face constitutes one of faces defining a space in which a machine room accommodating a compressor is provided.

8. The outdoor unit of claim 1, wherein at least one of the one side face and the other side face is provided with a side face side holding part.

* * * * *